US006412735B1

(12) United States Patent
Mathieu

(10) Patent No.: US 6,412,735 B1
(45) Date of Patent: Jul. 2, 2002

(54) MECHANISM FOR GRASPING IMPLEMENTS METHOD OF MANUFACTURING SAME, AND FASTENING DEVICES EMPLOYED THEREIN

(75) Inventor: Charles F. Mathieu, Jersey City, NJ (US)

(73) Assignee: Crossroads Product Group, Inc., Union City, NJ (US)

( * ) Notice: Subject to any disclaimer, the term of this patent is extended or adjusted under 35 U.S.C. 154(b) by 0 days.

(21) Appl. No.: 09/488,759

(22) Filed: Jan. 21, 2000

(51) Int. Cl.[7] ..... A46B 17/02

(52) U.S. Cl. ..... 248/110; 248/146; 248/147; 211/66; 211/70.6; 211/70.8

(58) Field of Search ..... 248/110, 147, 248/146; 211/66, 70.6, 70.8

(56) References Cited

U.S. PATENT DOCUMENTS

| | | | | | |
|---|---|---|---|---|---|
| 2,121,307 | A | * | 6/1938 | Swift | 15/104 |
| 4,995,509 | A | * | 2/1991 | Kornfeind | 206/209.1 |
| 5,072,904 | A | * | 12/1991 | Taylor | 248/110 |
| 5,450,970 | A | | 9/1995 | Mitchell | 211/65 |
| 5,609,259 | A | * | 3/1997 | Menard | 211/66 |
| 5,678,700 | A | * | 10/1997 | Crosson, Jr. | 211/70.8 |
| 5,738,228 | A | * | 4/1998 | Bittinger | 211/69.1 |
| 5,947,276 | A | * | 9/1999 | Hsu | 206/214 |
| 6,041,947 | A | * | 3/2000 | Heneveld | 211/70.6 |

FOREIGN PATENT DOCUMENTS

| | | |
|---|---|---|
| CH | 142400 | 11/1930 |
| GB | 136258 | 1/1920 |

* cited by examiner

*Primary Examiner*—Leslie A. Braun
*Assistant Examiner*—Steven Marsh
(74) *Attorney, Agent, or Firm*—Roberts Abokhair & Mardula, LLC

(57) ABSTRACT

Plural resilient gripping members grasp the handle or shaft of a toothbrush. Two opposed sets of resilient gripping members are mounted in a recess in the body of the toothbrush holder to form a grasping mechanism. Because the gripping members are resiliently deformable, they will grip between one another brush handles that have a wide range of dimensions and profiles.

5 Claims, 15 Drawing Sheets

FIG. 7
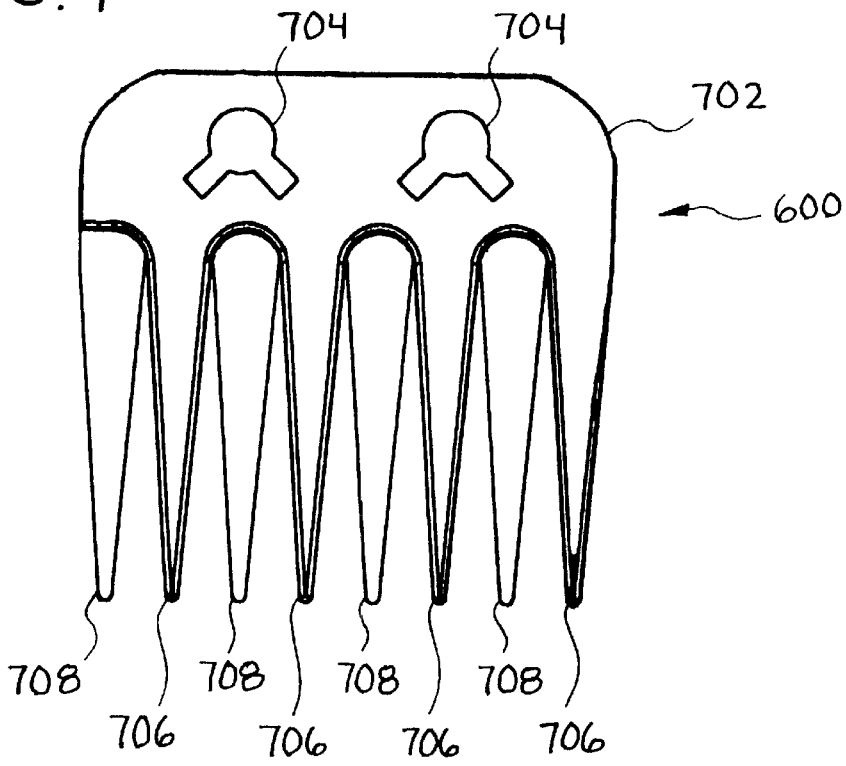
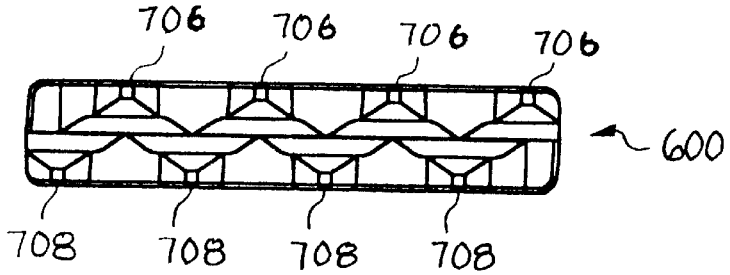
FIG. 8
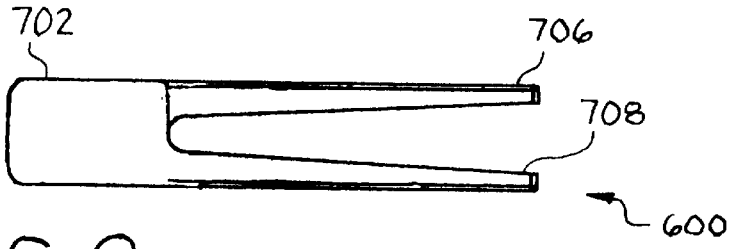
FIG. 9

MECHANISM FOR GRASPING IMPLEMENTS METHOD OF MANUFACTURING SAME, AND FASTENING DEVICES EMPLOYED THEREIN

BACKGROUND OF THE INVENTION

1. Field of the Invention

The present invention relates generally to the field of implement holders. More particularly, the present invention relates to a universal toothbrush holder that hygienically and conveniently holds virtually any size toothbrush.

2. Background Information

In recent years, the human factors design principles have been increasingly applied in the field of dental hygiene. This has resulted in many new toothbrush designs that are intended to provide more effective cleaning and/or be more ergonomically advantageous. One trend that has resulted is that many new toothbrush designs have fatter (i.e., increased circumference) handles than more traditional toothbrushes.

Another common feature of recent toothbrush designs targeted at the juvenile market is forming the end of the toothbrush handle in the shape of the head of a cartoon character. These design features are typically larger in size than the handle on which they are disposed.

This gives rise to a problem because old-fashioned toothbrush holders have fixed size apertures that are sized for traditional, thin handled toothbrushes. The new toothbrushes with fat handles just won't fit in the old holders. Referring to FIG. 1, a prior art toothbrush holder 102 (shown in detail view) has a fixed size aperture 104. The handle of a typical fat handle toothbrush 106 cannot fit through the aperture 104. As a result, prior art toothbrush holders like the one illustrated in FIG. 1 work only for a fraction of the types and sizes of toothbrushes that are sold or manufactured.

Referring to FIG. 2, one prior art attempt at solving this problem is illustrated. A toothbrush holder 202 has an aperture 204 with a narrowed portion 206. The head of a toothbrush 210 (shown in phantom) is inserted upwardly through the aperture 204 from below. The bristles 212 of the brush 210 are squeezed up through the narrow portion 206 of the aperture 204 and rest directly on a surface 208 of the holder 202. Because the head of the toothbrush 210 is inserted into the aperture from below, rather than dropping the handle into the aperture from above as required by traditional holders, the holder of FIG. 2 avoids the problem of how to hold toothbrushes with handles of varying sizes.

One disadvantage of the prior art holder 202 of FIG. 2 is that it is unsanitary. Germs may be passed from one person to another via the toothbrush holder 202 because the bristles of the brushes come into direct contact with the surface 208 of the holder 202. Additionally, because the bristles 212 rest in contact with the surface 208, the bristles are not free to air dry thoroughly, thus forming an environment conducive to growth of mildew and other organisms. Furthermore, when the bristles 212 are forced through the narrowed aperture 206, they are caused to spatter water droplets up into the air, thereby spreading germs to nearby surfaces, including the bristles of adjacent toothbrushes.

An additional disadvantage of the prior art holder of FIG. 2 is that it is inconvenient. Proper use of the holder 202 calls for the user to align the toothbrush head with the aperture from below. However, most users cannot directly view the underside of the holder 202. This maneuver is not difficult for many adults. However, for persons with impaired motor skills (or for children), this can be a tricky, inconvenient task.

Another prior art solution to the problem of how to store fat handled toothbrushes is to simply stand the toothbrushes up in a cup. This is an unsuitable solution because it is unsanitary and unstable. It is unsanitary because the bristles of different persons brushes are free to come in contact with one another as they move about in the cup. It is unstable because the cup is prone to tipping over if too many brushes end up on the same side of the cup.

Simply making the apertures bigger is not a suitable solution because that does not solve the problem of how to accommodate brushes having diverse shapes and sizes. Thin handled brushes or short handled brushes would rest in the holder with their bristles on the surface of the holder, which is an unsanitary condition.

Thus, what is needed is a toothbrush holder that can hold toothbrushes having varying sizes and shapes of handles. Additionally, what is needed is a grasping mechanism that will securely grip implements of varying diameters and shapes.

SUMMARY OF THE INVENTION

It is an object of the present invention to provide a toothbrush holder than can hold toothbrushes having varying sizes and shapes of handles.

It is another object of the present invention to provide a grasping mechanism that will securely grip implements having diverse diameters and shapes.

It is yet another object of the present invention to provide a method of manufacturing a toothbrush holder.

It is still another object of the present invention to provide a fastening device for use in a toothbrush holder.

It is a further object of the present invention to provide a toothbrush holder that is sanitary and stable.

It is a still further object of the present invention to provide a toothbrush holder than may be selectively removed from a wall mounting to be cleaned.

Plural resilient grasping members grasp the handle or shaft of a toothbrush. Two opposed sets of resilient grasping members are mounted in a recess in the body of the toothbrush holder to form a grasping mechanism. Because the grasping members are resiliently deformable, they will grip between one another objects that have a wide range of dimensions and profiles. A functionality of a holder embodying this grasping mechanism is that it enables almost any toothbrush to be inserted in a nearly effortless downward motion. As the toothbrush handle is downwardly inserted into the grasping mechanism, when the desired position is selected and the downward motion stops, the inserted toothbrush will remain in that exact position until removed.

Some of the above objects are obtained by an apparatus for grasping and holding implements. This apparatus includes a body and a support structure connected to the body for supporting it. The apparatus also includes one or more grasping mechanisms that are disposed in the body, wherein each of the one or more grasping mechanisms has plural, opposed resiliently deformable grasping members.

Others of the above objects are obtained by a toothbrush holder. The toothbrush holder includes a body and a support structure connected to the body for supporting it. The toothbrush holder also includes one or more toothbrush graspers disposed in the body, wherein each of the one or more graspers has plural, opposed resiliently deformable grasping members.

Still others of the above objects are obtained by a fastener device for affixing a resilient body to a rigid body. The fastener device includes a pair of opposed, arcuate upright portions, and one or more alignment members. Each of the alignment members is formed integrally with and extends outwardly from one of the upright portions. The fastener device also includes one or more retaining lips, wherein each of the retaining lips is formed at the periphery of an extreme end of one of the upright portions.

Some of the above objects are also obtained by a method for manufacturing a gripping mechanism. This manufacturing method includes forming a main body having recesses, and forming plural grasping bodies, such that each of the plural grasping bodies has plural grasping members. The method further includes fastening the plural grasping bodies in opposed pairs in the recesses on the main body.

Certain of the above objects are also obtained by a grasping mechanism that includes two sets of plural resilient grasping members. For each of the two sets of plural resilient grasping members, each of the grasping members is substantially elongated along a respective longitudinal axis, and their respective longitudinal axes are substantially parallel to one another. The first set and the second set are arranged in proximate opposition to one another.

Additional ones of the above objects are obtained by a bracket for mounting an object to a wall. The bracket includes a reversible body and double sided tape. The reversible body is shaped to fit via sliding engagement into a recess on the object to be mounted, the body having a pair of opposed faces. The double-sided tape is affixed to one of the opposed faces. Plural countersunk holes are formed in the body, wherein the holes are adapted to accommodate screw fasteners. The orientation of the bracket body for engagement with respect to the object (e.g., a toothbrush holder) is reversible such that the bracket is mounted to the wall either via adhesion of the tape, or via mechanical fastening by screws.

BRIEF DESCRIPTION OF THE DRAWING

Additional objects and advantages of the present invention will be apparent in the following detailed description read in conjunction with the accompanying drawing figures.

FIG. 7 illustrates a plan view of the one-sided grasping body of FIG. 6.

FIG. 8 illustrates a front view of the one-sided grasping body of FIG. 6.

FIG. 9 illustrates an elevation view of the one-sided grasping body of FIG. 6.

DETAILED DESCRIPTION OF THE INVENTION

Plural resilient grasping members grasp the handle or shaft of a toothbrush. Two opposed sets of resilient grasping members are mounted in a recess in the body of the toothbrush holder to form a grasping mechanism. Because the grasping members are resiliently deformable, they will grip between one another objects that have a wide range of dimensions and profiles.

The plural grasping members of each grasping mechanism are arranged in a manner that is intended to hold a generally elongate object in a stable manner. Arranging the grasping members in parallel with one another according to a staggered array distribution promotes stability of the holding function. That is because such an arrangement causes the elongate object to come in contact with at least three grasping members. At least two of those three grasping members will preferably apply opposed reaction forces to the elongate object, thereby holding onto the object by friction force.

Any number of grasping mechanisms may be formed in the body of the holder, and the holder body may be configured in a wide variety of shapes. The holder body may be mounted on a wall or in a cabinet. The holder body may be freestanding for placement on a countertop.

Figure 1:
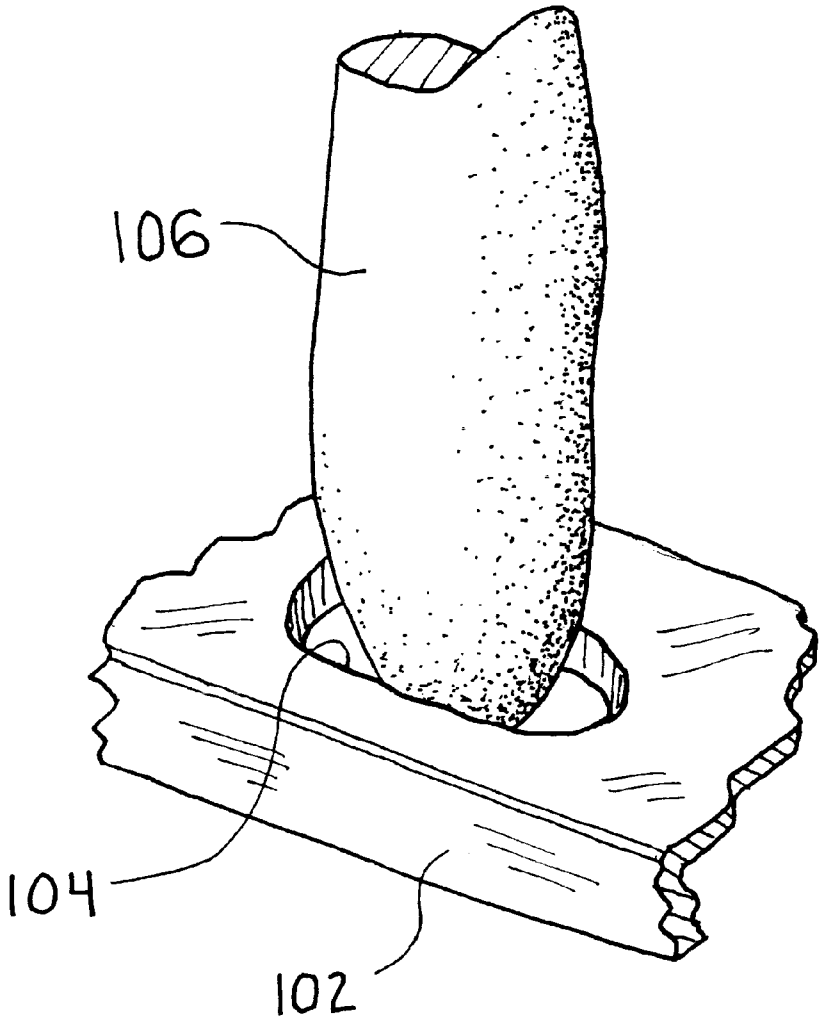
FIG. 1 PRIOR ART
FIG. 1 illustrates a detail view of a prior art toothbrush holder juxtaposed with the handle of a toothbrush.
Figure 2:
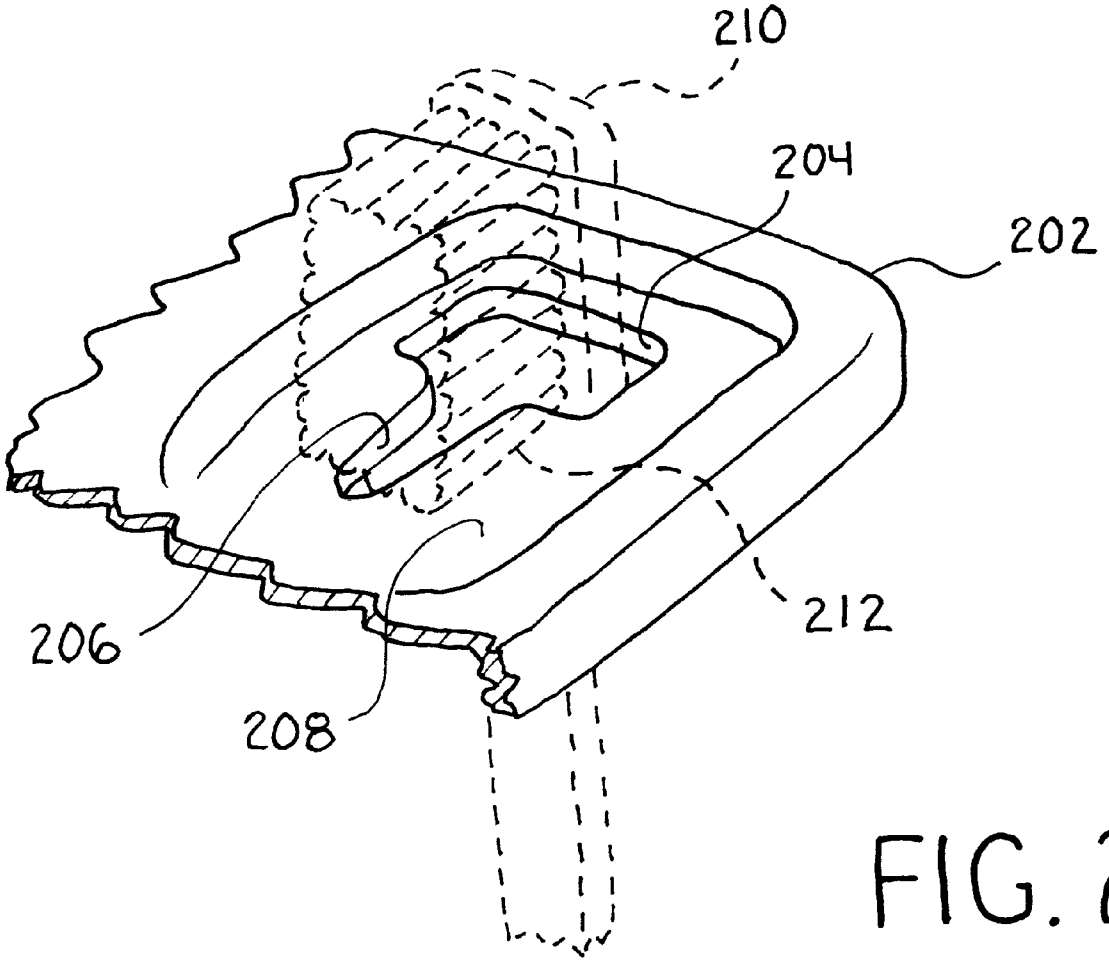
FIG. 2 PRIOR ART
FIG. 2 illustrates a detail view of another prior art toothbrush holder holding a toothbrush that is shown in phantom.
Figure 3:
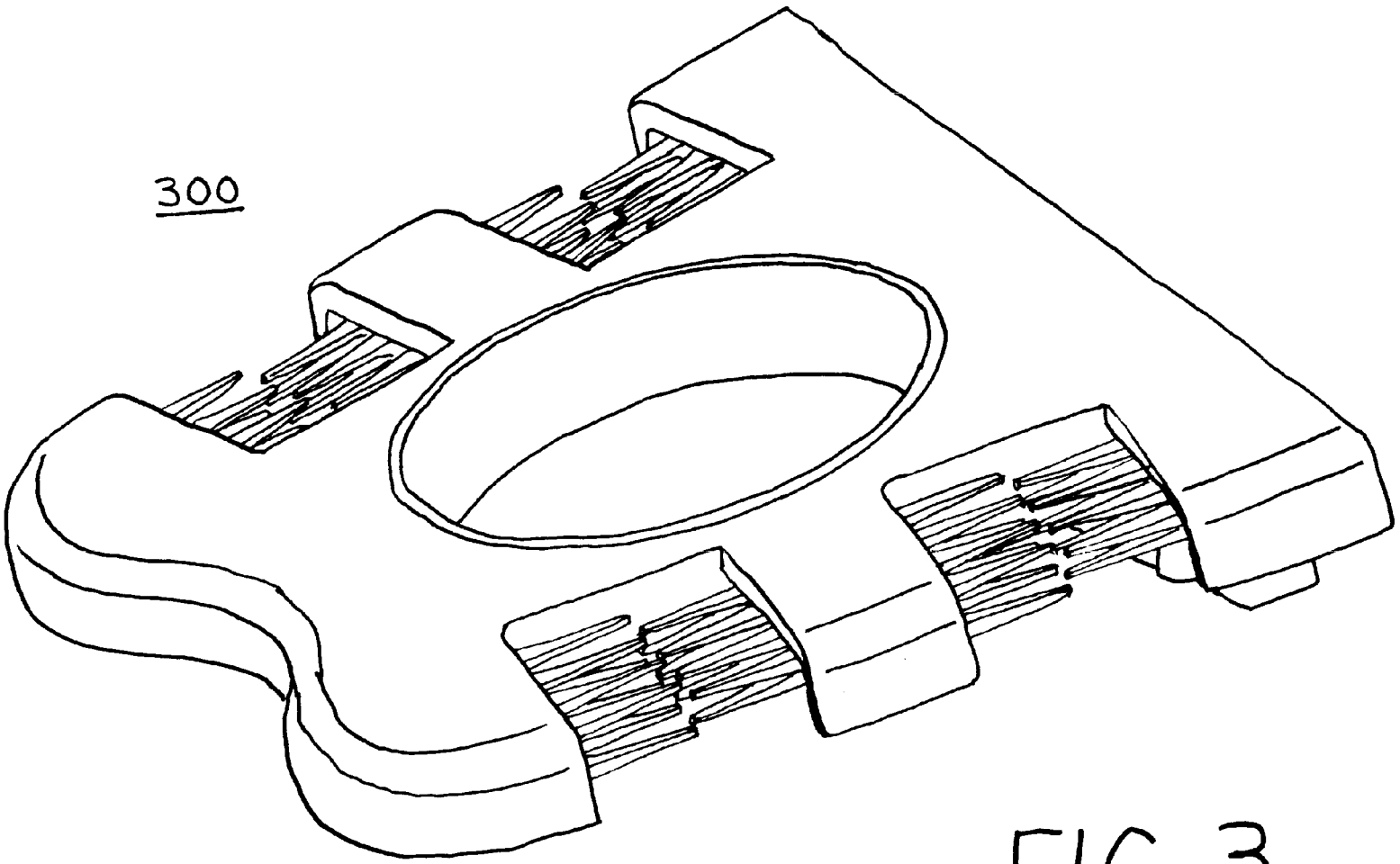
FIG. 3 illustrates a perspective view of a toothbrush holder according to a preferred embodiment of the present invention.

Referring to FIG. 3, a perspective view of a toothbrush holder 300, according to a preferred embodiment of the present invention, is illustrated. This toothbrush holder 300 is intended to be mounted to a wall (not shown) via a fastening mechanism that is described in detail below.

Figure 4:
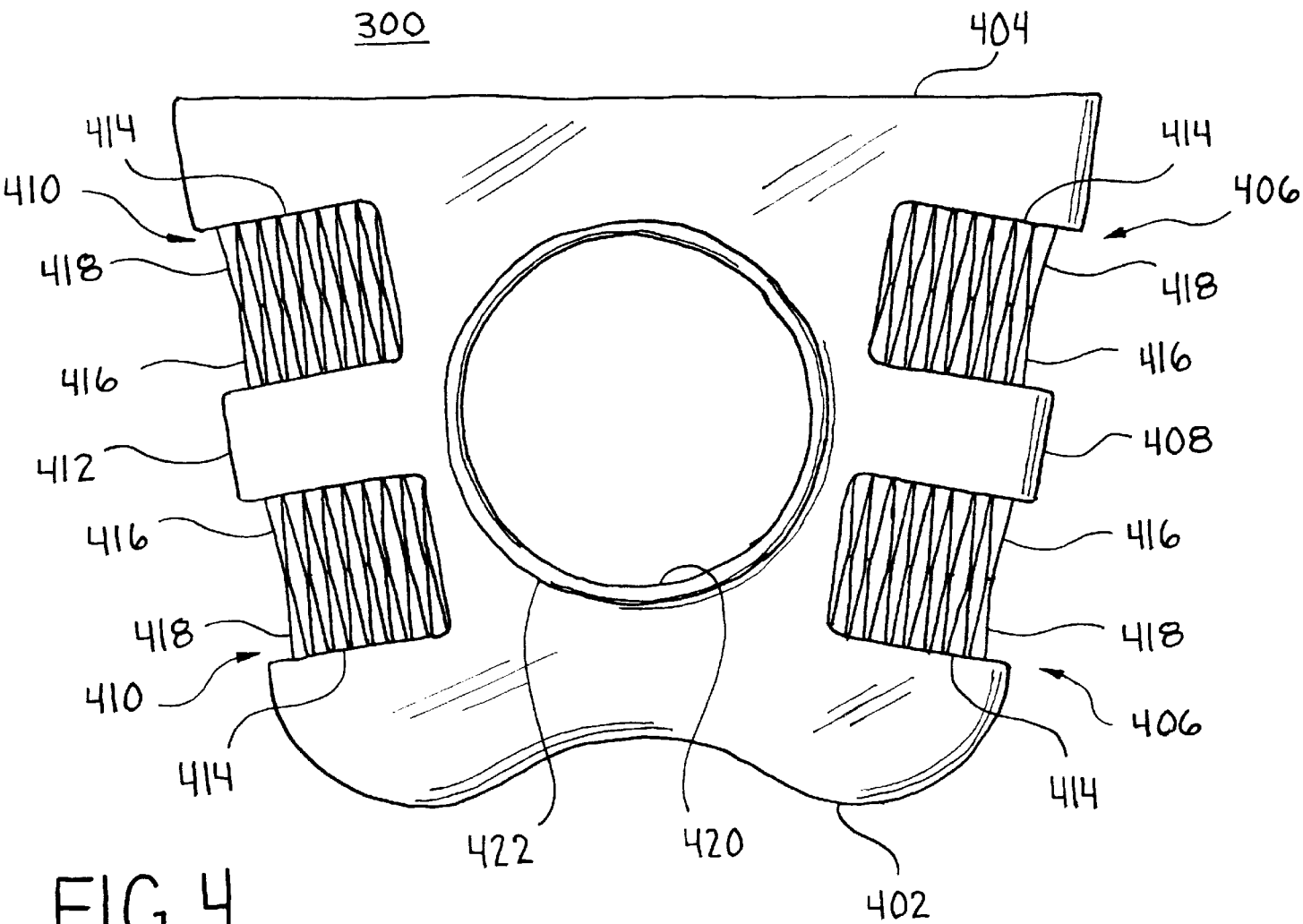
FIG. 4 illustrates a plan view of the toothbrush holder of FIG. 3.

Referring to FIG. 4, a plan view of the toothbrush holder 300 of FIG. 3 is illustrated. The body 402 of the holder 300 has a pair of grasping mechanisms 406 formed in the right side 408 of the body 402, and a pair of grasping mechanisms 410 formed in the left side 412 of the body 402. Each of the grasping mechanisms 406, 410 is formed in a recess 414 in the body 402 of the holder 300. The grasping mechanisms 406, 410 each have a first group of parallel grasping members 416, and a second group of parallel grasping members 418. The body 402 of the holder 300 has a large hold 420 surrounded by a raised, rounded lip 422 to form a cup holder. The body 402 of the holder 300 is preferably formed of a rigid polymer resin.

Figure 5:
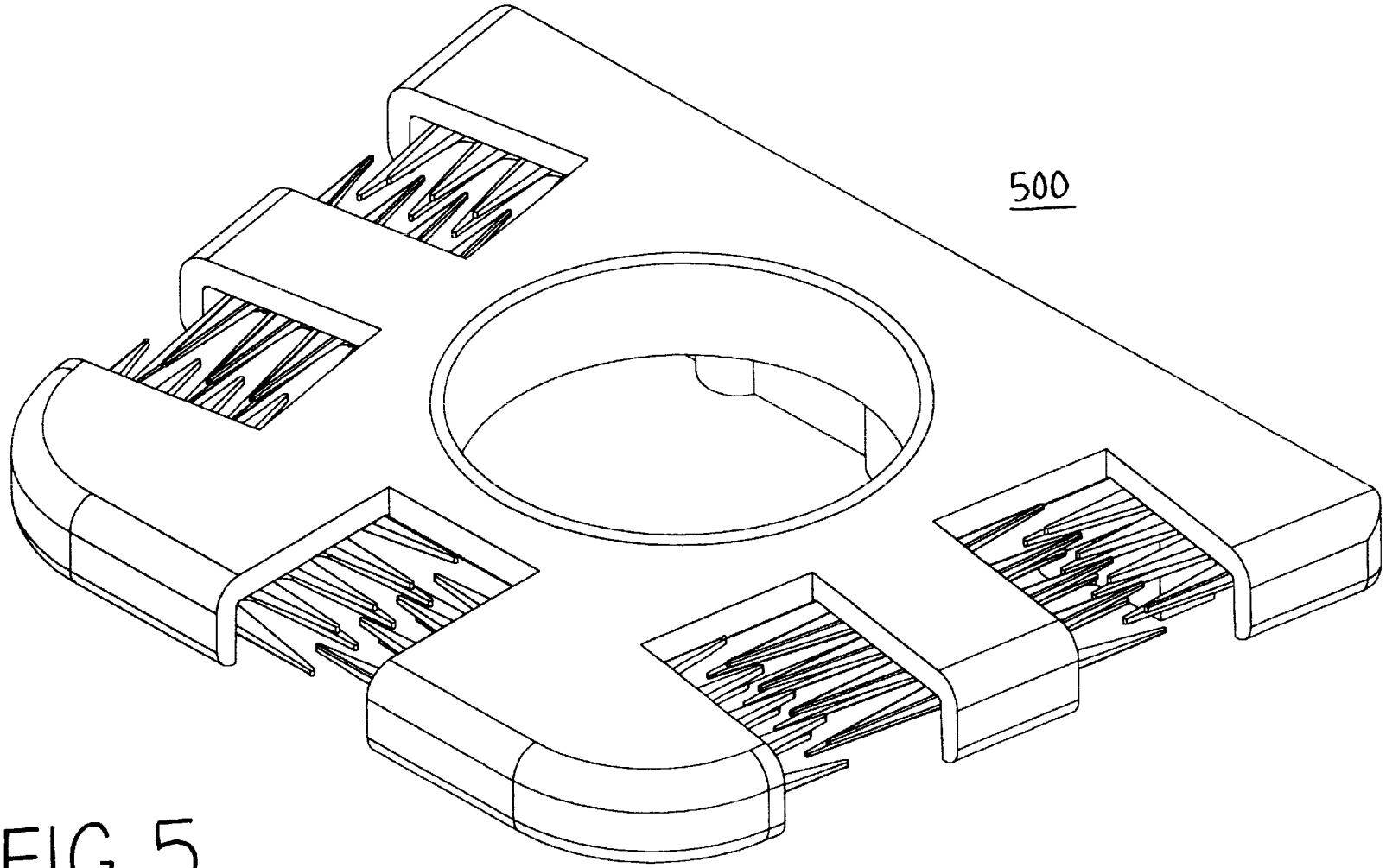
FIG. 5 illustrates a perspective view of a toothbrush holder according to an alternate embodiment of the present invention.

Referring to FIG. 5, a perspective view of a toothbrush holder 500, according to an alternate embodiment of the present invention, is illustrated. This embodiment of the holder 500 has five grasping mechanisms, rather than four as in the embodiment illustrated in FIGS. 3 & 4.

Figure 6:
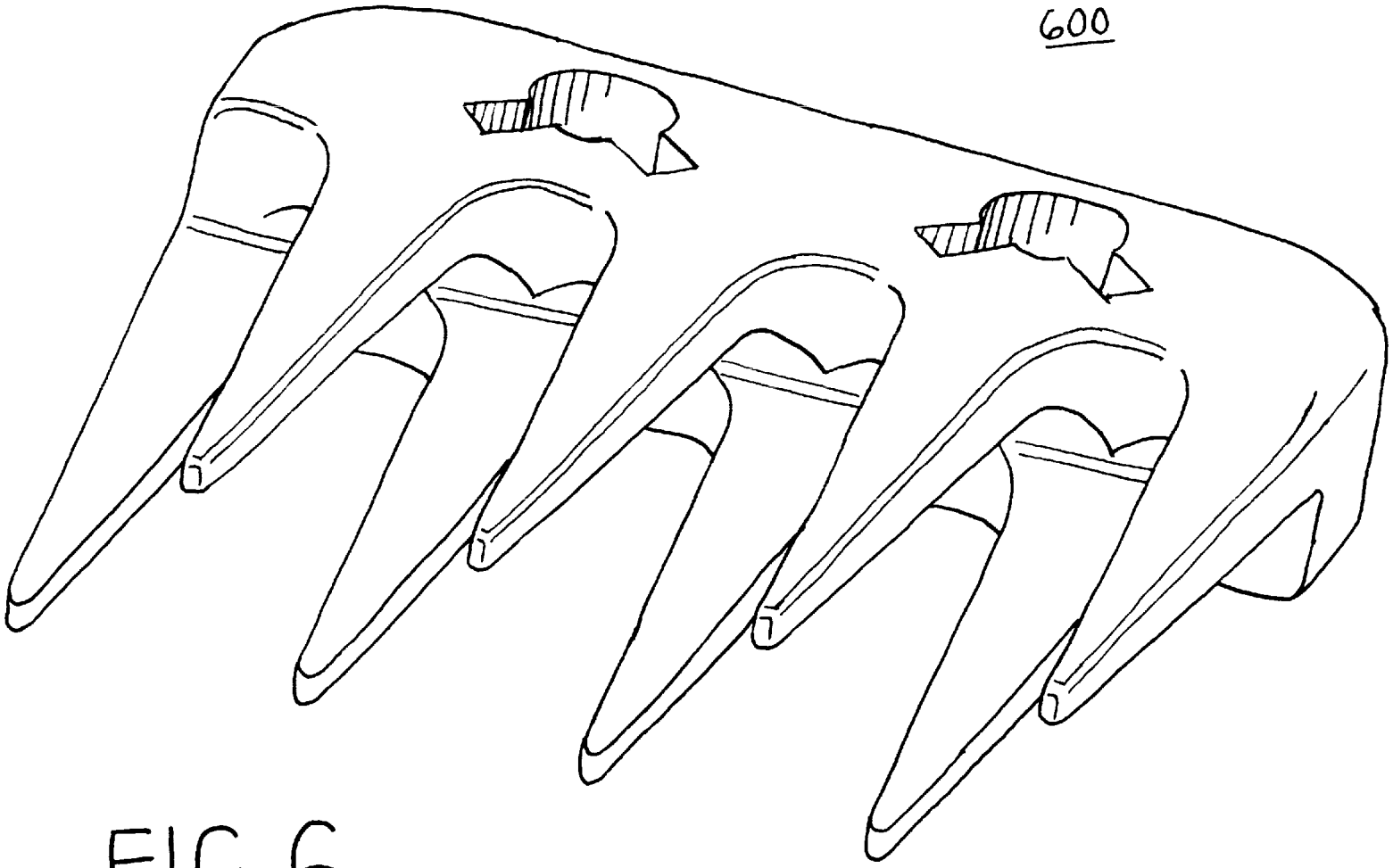
FIG. 6 illustrates a perspective view of a one-sided grasping body according to an embodiment of the present invention.

Referring to FIG. 6, a perspective view of a one-sided grasping body 600, according to an embodiment of the present invention, is illustrated. The one-sided grasping body 600 provides groups of parallel grasping members such as the second groups of grasping members 418 shown in FIG. 4. The grasping members are configured in this illustrated example as two adjacent rows that are laterally staggered with respect to one another. Alternatively, the grasping members may be aligned with one another in a non-staggered configuration. Both the staggered and non-staggered configurations are equally functional. The staggered configuration is preferred for reasons of expediency of manufacture.

Referring to FIGS. 7–9, the one-sided grasping body 600 of FIG. 6 is further illustrated in plan view, front view, and elevation view, respectively. The grasping body 600 has a main body 702 with two mounting holes 704 formed there through. An upper set of grasping members 706 extends outwardly from the main body 702, as does a lower set of grasping members 708. The grasping member 706, 708 are preferably aligned so that they are substantially parallel to one another. The grasping body 600 is preferably formed of a resilient (i.e., memory resistant) polymer resin.

Figure 10:
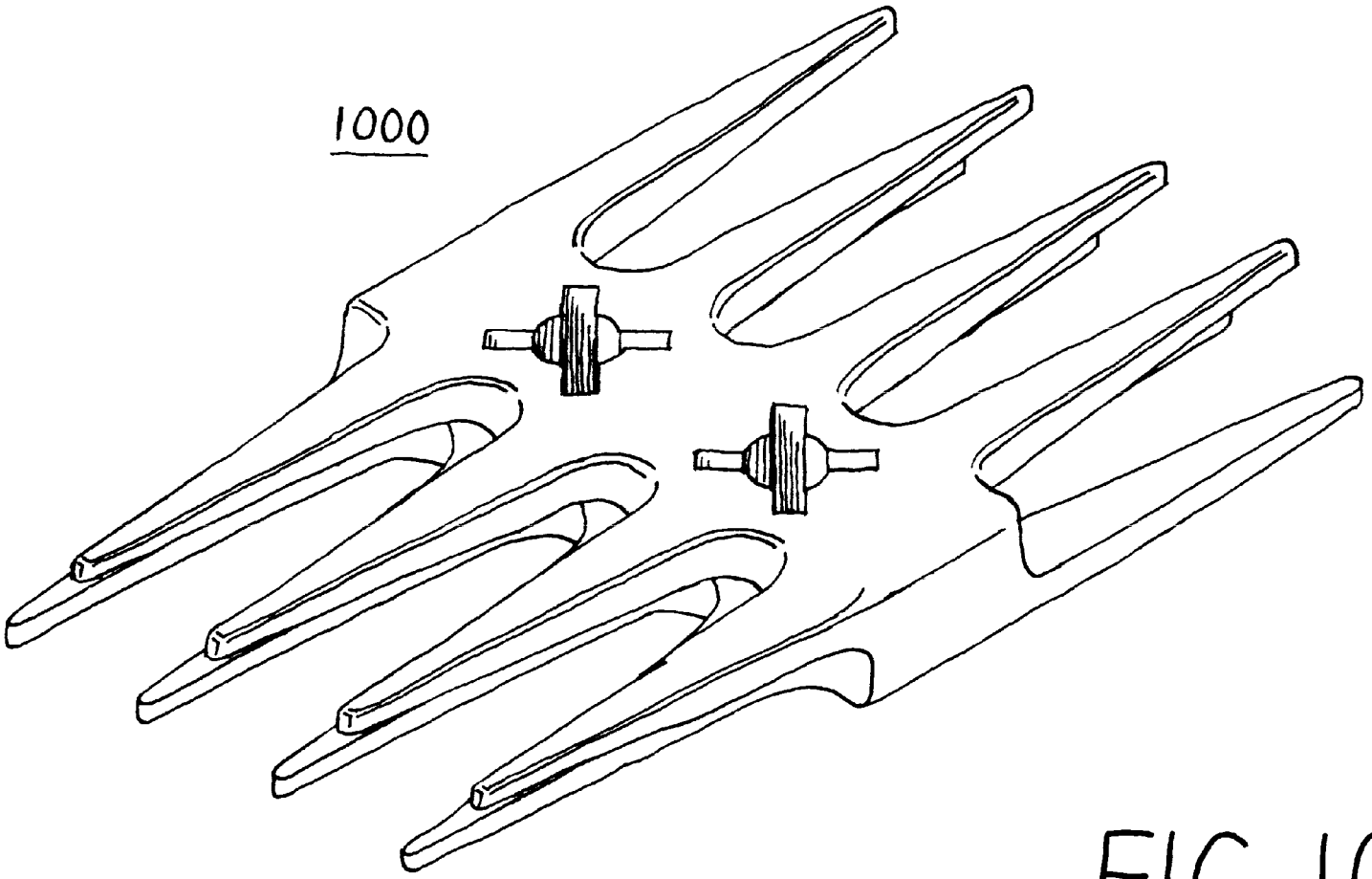
FIG. 10 illustrates a perspective view of a two-sided grasping body according to an embodiment of the present invention.

Referring to FIG. 10, a perspective view of a two-sided grasping body 1000, according to an embodiment of the present invention, is illustrated. The two-sided grasping body 1000 provides groups of parallel grasping members such as the first groups of grasping members 416 shown in FIG. 4.

Figure 11:
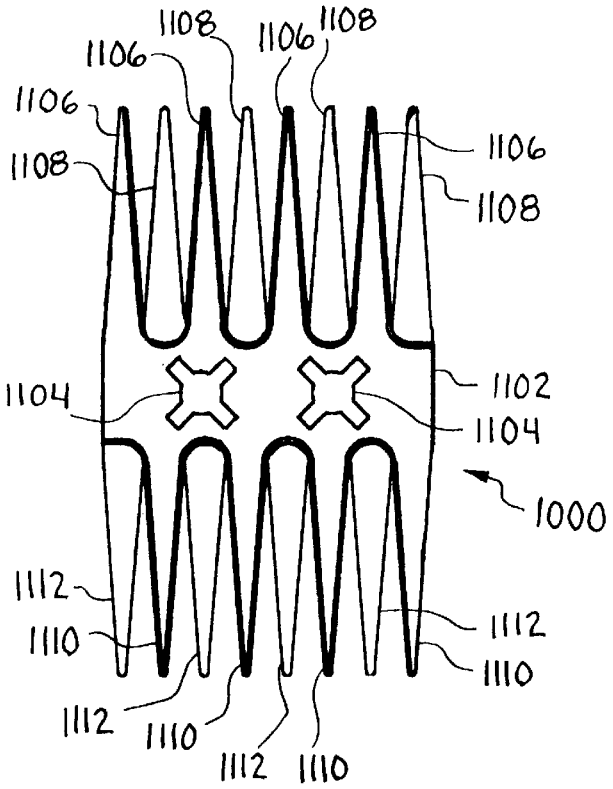
FIG. 11 illustrates a plan view of the two-sided grasping body of FIG. 10.
Figure 12:
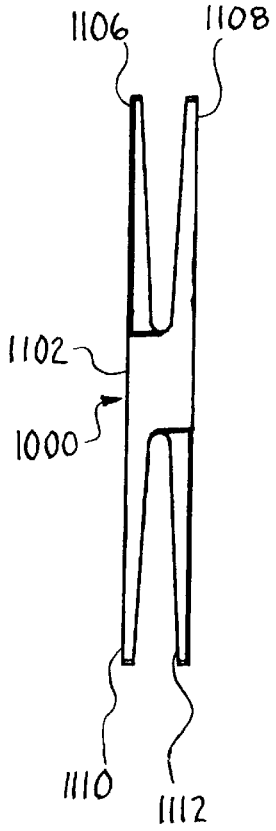
FIG. 12 illustrates an elevation view of the two-sided grasping body of FIG. 10.
Figure 13:
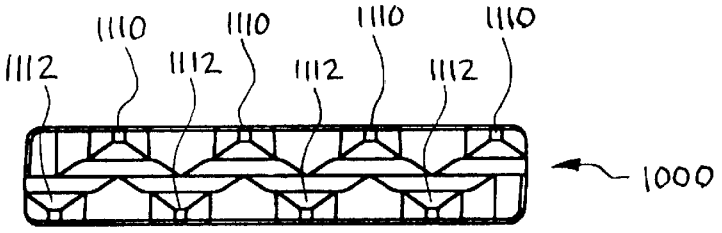
FIG. 13 illustrates a front view of the two-sided grasping body of FIG. 10.

Referring to FIGS. 11–13, the two-sided grasping body 1000 of FIG. 10 is further illustrated in plan view, elevation view, and front view, respectively. The grasping body 1000 has a main body 1102 with two mounting holes 1104 formed there through. An upper set of grasping members 1106 and a lower set of grasping members 1108 extend outwardly from the main body 1102 in a first direction. Another upper set of grasping members 1110 and another lower set of grasping members 1112 extend outwardly from the main body 1102 in a second direction, opposed to the first direction. The grasping member 1106, 1108, 1110, 1112 are preferably aligned so that they are substantially parallel to one another. The grasping body 1000 is preferably formed of a resilient (i.e., memory resistant) polymer resin.

Figure 14:
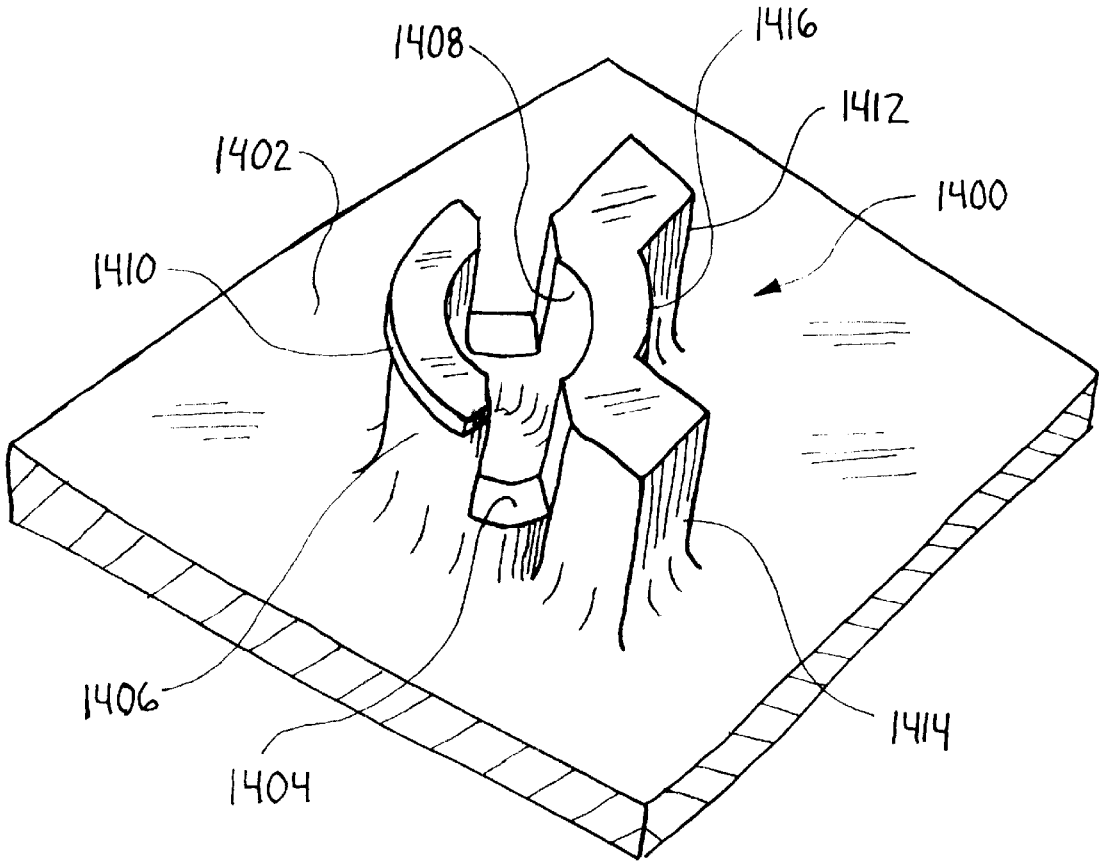
FIG. 14 illustrates a detail view of a one-sided fastener device according to an embodiment of the present invention.
Figure 14A:
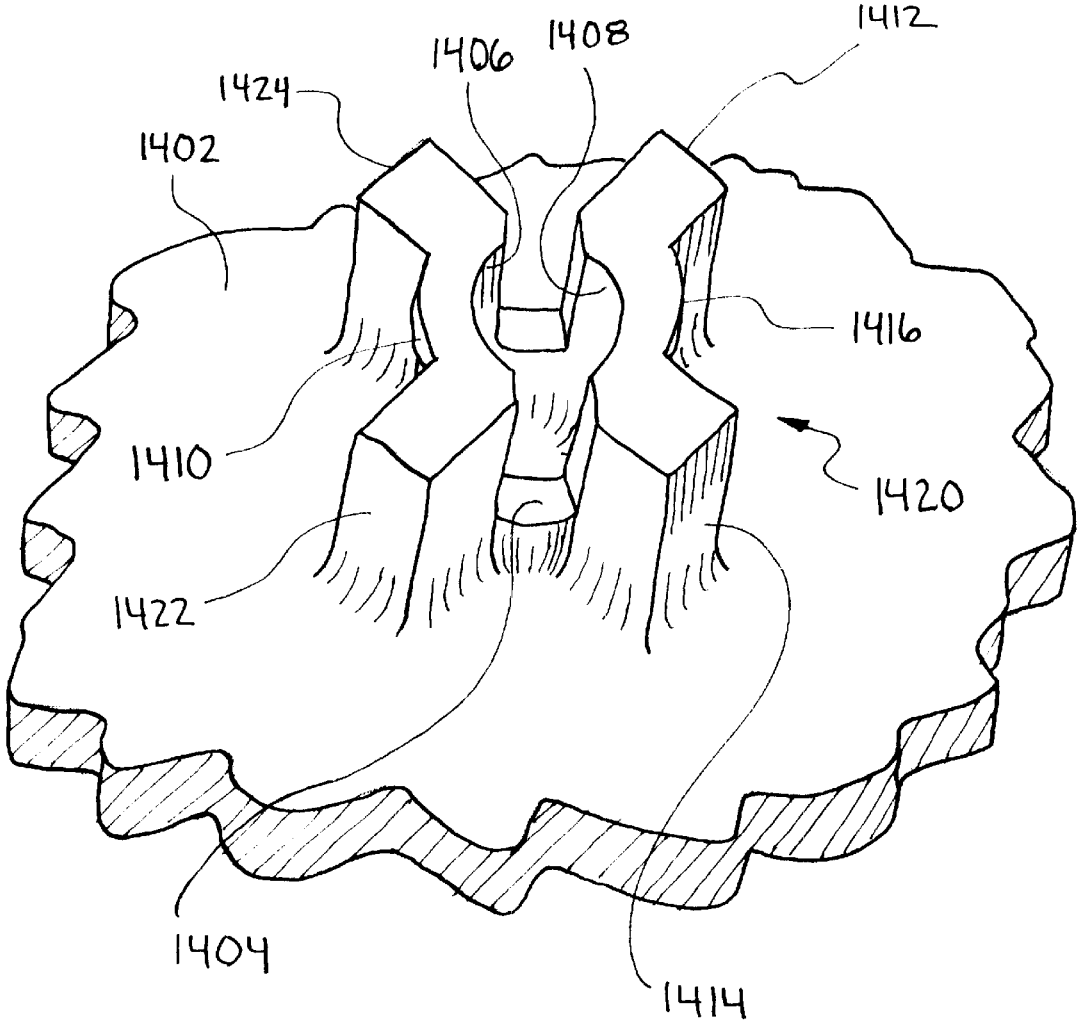
FIG. 14A illustrates a detail view of a two-sided fastener device according to an embodiment of the invention.

Referring to FIG. 14, a detail view of a one-sided fastener device 1400, according to an embodiment of the present invention, is illustrated. The fastener device 1400 is preferable formed integrally with an underside of the body 1402 of the toothbrush holder, for example, by an injection molding process. The base portion 1404 of the fastener device 1400 has a tubular configuration. Opposed arcuate upright portions 1406, 1408 extend from the tubular base portion 1402. Two alignment members 1412, 1414 extend radially outwardly from one of the upright portions 1408 and extend from the holder body 1402 to the extreme end of the upright portion 1408. A retaining lip 1410 extends radially outward from the extreme end of the other upright portion 1406. Preferably, the upright portion 1408 having alignment members 1412, 1414 also has a retaining lip 1416 at its extreme end, which extends between the alignment members 1412, 1414.

The one-sided fastener device 1400 is sized to have a close fit with the mounting holes 704 of the one-sided grasping body 600 (refer to FIGS. 6–9). The grasping body is retained on the fastening device 1400 by the retaining lips 1410, 1416.

A fastener device according to the present invention may also be embodied as a two-sided fastener device 1420, which includes four alignment members. In addition to the alignment members 1412, 1414 of the one-sided version, the two sided fastener device 1420 has two alignment members 1422, 1424 that extend radially outward from the upright portion 1406. Thus, the alignment members 1412, 1414, 1422, 1424 are arranged as two pairs with each pair extending radially outwardly from one of the upright portions. The two-sided fastener device 1420 is sized to have a close fit with the mounting holes 1104 of the two-sided grasping body 1000 (refer to FIGS. 10–13).

Figure 15:
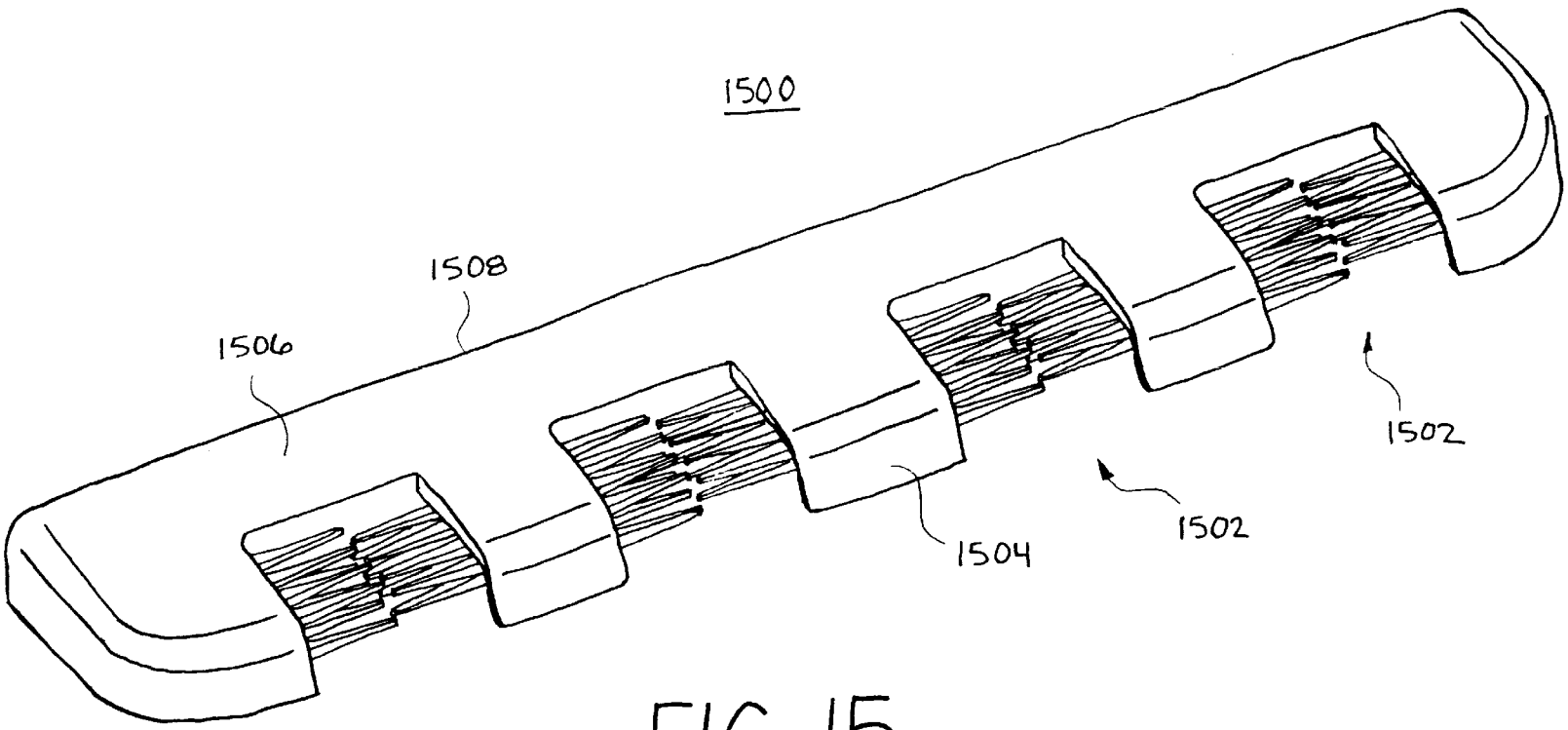
FIG. 15 illustrates a perspective view of a toothbrush holder according to an alternate embodiment of the present invention.

Referring to FIG. 15, a perspective view of a toothbrush holder 1500, according to an alternate embodiment of the present invention, is illustrated. This alternate embodiment omits the cup holder feature and arranges the grasping mechanisms 1502 in a linear row along the front edge 1504 of the body 1506 of the holder 1500. The number of grasping mechanisms 1502 is not critical; a single grasping mechanism or any plural number of grasping mechanisms would be suitable. The holder 1500 is mounted to the wall, via conventional fastening means, at the rear edge 1508 of the body 1506.

Figure 16:
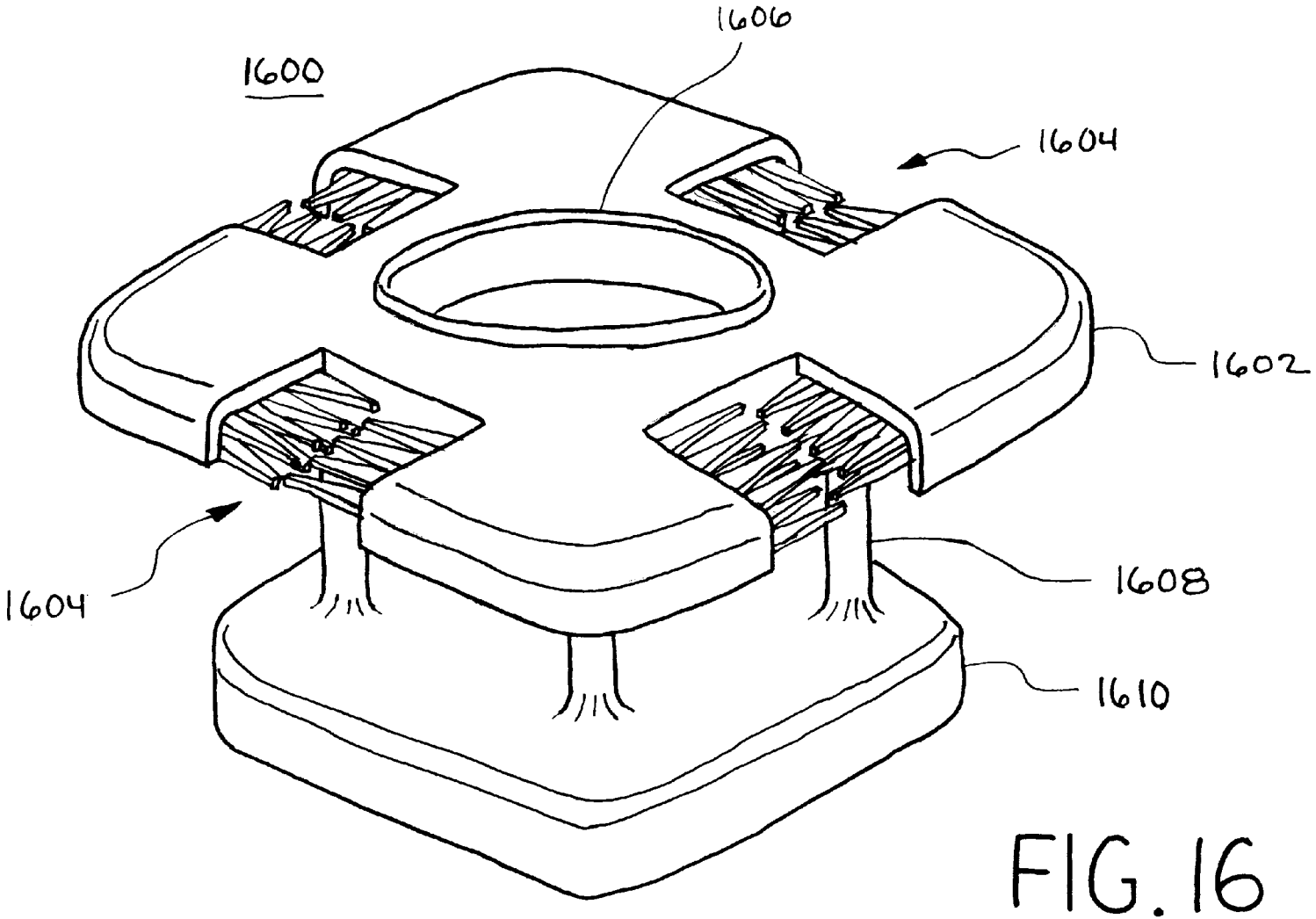
FIG. 16 illustrates a perspective view of a toothbrush holder according to another alternate embodiment of the present invention.

Referring to FIG. 16, a perspective view of a toothbrush holder 1600, according to another alternate embodiment of the present invention, is illustrated. Rather than being wall mounted like the other embodiments described above, the holder 1600 of this alternate embodiment is free standing. Plural grasping mechanisms 1604 are arranged around the periphery of the holder body 1602, which has a cup holder feature 1606 at its center. Support members 1608 secure the body 1602 to a base 1610. The base 1610 is of sufficient size and weight to rest stably on a nominally flat surface, such as a bathroom countertop.

Figure 17:
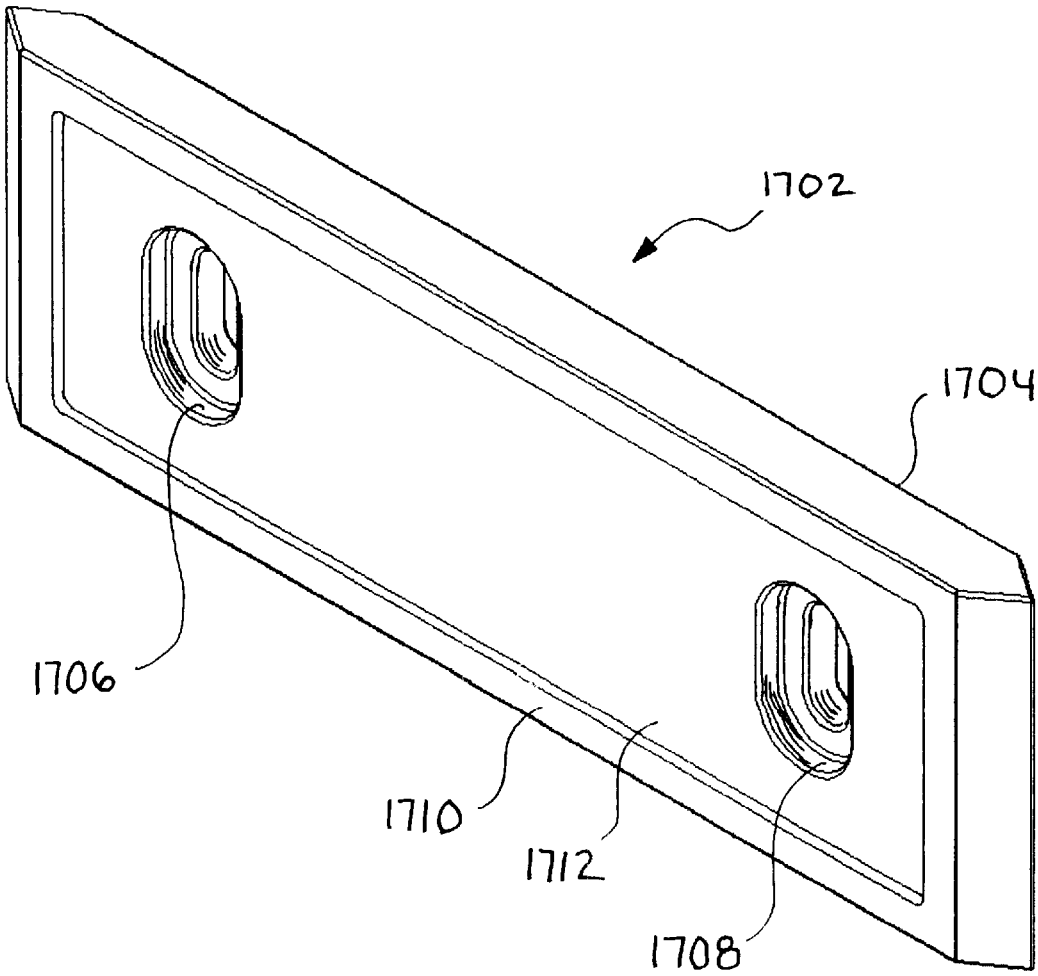
FIG. 17 illustrates a perspective view of a wall mount bracket according to one aspect of the present invention.

Another aspect of the present invention is a fastening mechanism for mounting the wall-mounted embodiments of the toothbrush holder to a wall. Referring to FIG. 17, the novel fastening mechanism is a reversible bracket 1702 that fits into a cavity (not shown) that is formed in the back of the toothbrush holder body. The bracket 1702 is reversible in order to provide a choice of alternative ways to fasten the holder to a wall.

When oriented in a first direction, a first side 1704 of the bracket 1702 is fastened to a wall by inserting screws into a set of countersunk holes 1706, 1708 and then screwing the screws into the wall.

When oriented a second, opposite direction, a second side 1710 of the bracket is fastened to the wall by a piece of double-sided industrial strength tape (not shown). One side of the tape is exposed and fitted into the recessed portion 1712. The exterior side of the tape is then exposed by peeling off a protective film and the second side 1710 is then fastened to the wall Using either scheme to fasten the bracket to the wall, the holder is then affixed to the wall by sliding the holder so that the bracket fits into the bracket cavity. An advantageous result of this mounting arrangement is that the toothbrush holder can be selectively removed from the bracket for washing, preferably in a dishwasher.

Holder apparatus according to the present invention are manufactured according to a process described as follows. The body and other support structures (i.e., wall mount fastener or free standing support base) are formed of rigid materials. Polymer resins have been found to be a quite suitable material for these structures. Other suitable materials include ceramic, wood, and metal.

Although the fastener device described above with reference to FIG. 14 was described as being integrally molded from plastic along with the body of the holder, the invention may be embodied differently. The fastener device may be formed separately of a material that is either the same or different from the material of the body. The separately formed fastener is then affixed to the body either mechanically or adhesively.

As yet another alternative, other conventional fasteners (screws, rivets, etc.) may be used in lieu of the novel fastener disclosed above.

The grasping bodies are formed of a resilient, springy material. Polymer resins, such as synthetic rubber, have been found to be a quite suitable material for the grasping bodies. The material ORALITE™ has been discovered to be particularly suitable. Other suitable materials include metal and carbon fiber. Additionally, the grasping bodies may include grasping members that are formed of animal hair bristles or other organic material.

The grasping bodies are removably fixed to the body of a holder. The novel fastening devices disclosed above are most suitable for securing grasping bodies formed of resilient polymers. It is intended that the grasping bodies are to be removable for replacement by the user, in the event that they break or wear out. That is one reason why the novel fastening devices disclosed according to the present invention are particularly useful.

In the alternative, conventional fastening schemes may be appropriate for grasping bodies formed of other materials such as metal and carbon fiber.

Figure 18:
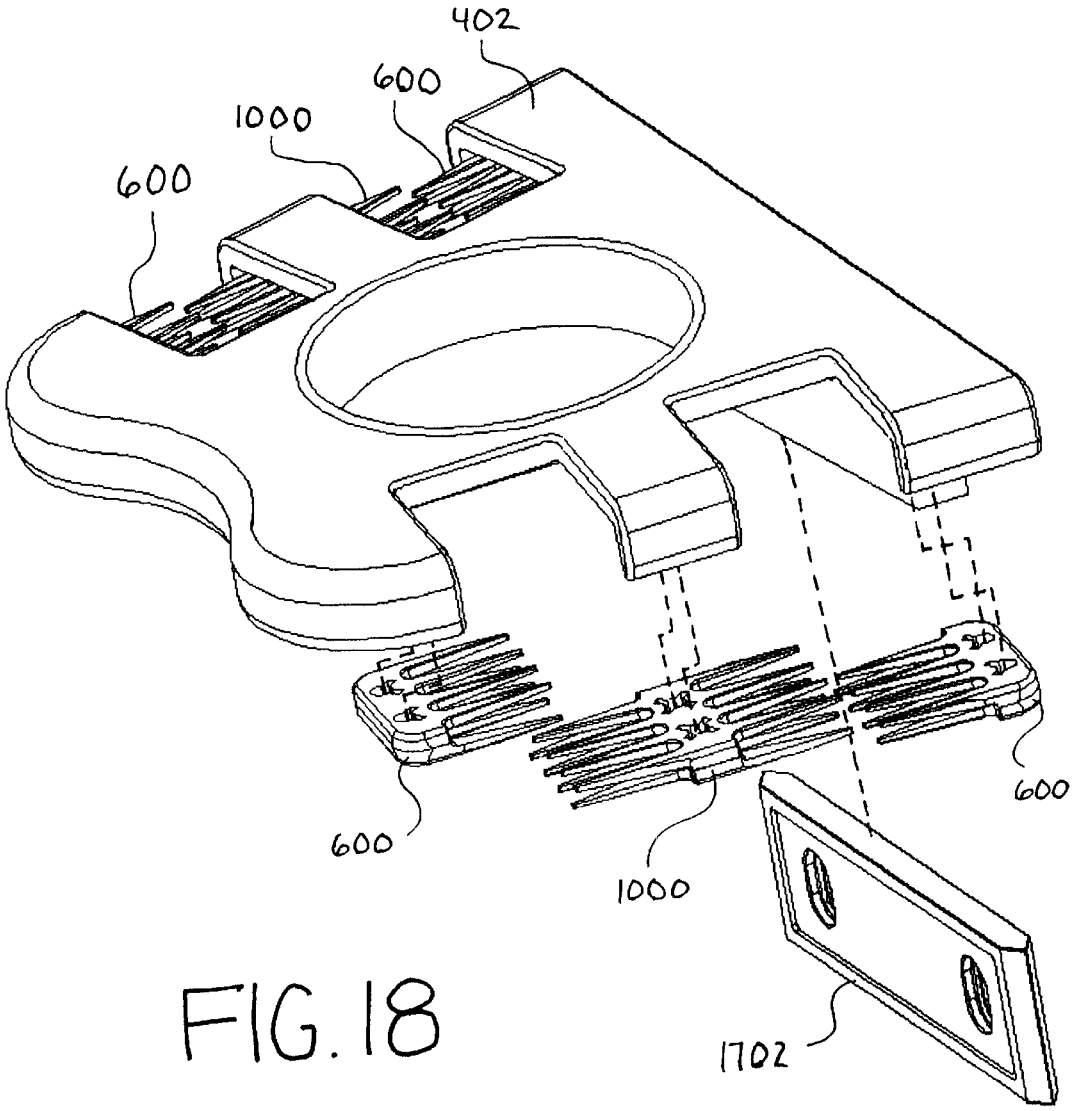
FIG. 18 illustrates a partially exploded view of components of a toothbrush holder according to the embodiment of FIG. 3.

Referring to FIG. 18, the integration of the various components of a toothbrush holder according to the present invention is illustrated via a partially exploded view. Four one-sided grasping bodies 600, as well as two two-sided grasping bodies 1000 are fastened to the underside of the holder body 402. A single bracket 1702 slides into a cavity (not shown) in the holder body 402.

The present invention has been described in terms of preferred embodiments, however, it will be appreciated that various modifications and improvements may be made to the described embodiments without departing from the scope of the invention.

What is claimed is:

1. An apparatus for grasping and holding implements, the apparatus comprising:

a body;

support structure connected to the body for supporting the body on a support surface; and one or more grasping mechanisms disposed in the body, each of the one or more grasping mechanisms being accessible via a recess in the side of the body, and each of the one or more grasping mechanisms comprising:

a first set of plural resilient grasping members, each of the grasping members in the first set being substantially elongated along a respective longitudinal axis, their respective longitudinal axes being substantially parallel to one another, wherein the grasping members in the first set are arranged in two linear rows that are arranged adjacent to one another; and a second set of plural resilient grasping members, each of the grasping members in the second set being substantially elongated along a respective longitudinal axis, their respective longitudinal axes being substantially parallel to one another, wherein the grasping members in the second set are arranged in two linear rows that are arranged adjacent to one another;

wherein the first set and the second set are arranged in proximate opposition to one another; and wherein, in each of the first set and the second set, the grasping members in one of the two linear rows are arranged so as to be staggered with respect to the grasping members in the other of the two linear rows;

whereby an implement inserted laterally into the recess is grasped and held between the first and second sets of plural resilient grasping members acting in cooperation with one another such that the implement is engaged by at least two of the grasping members that are staggered with respect to one another.

2. A toothbrush holder comprising:

a body;

support structure connected to the body for supporting the body on a support surface; and one or more toothbrush graspers disposed in the body, each of the one or more graspers being accessible via a recess in the side of the body, and each of the one or more graspers comprising;

a first set of plural resilient grasping members, each of the grasping members in the first set being substantially elongated along a respective longitudinal axis, their respective longitudinal axes being substantially parallel to one another, wherein the grasping members in the first set are arranged in two linear rows that are arranged adjacent to one another; and a second set of plural resilient grasping members, each of the grasping members in the second set being substantially elongated along a respective longitudinal axis, their respective longitudinal axes being substantially parallel to one another, wherein the grasping members in the second set are arranged in two linear rows that are arranged adjacent to one another;

wherein the first set and the second set are arranged in proximate opposition to one another; and wherein, in each of the first set and the second set, the grasping members in one of the two linear rows are arranged so as to be staggered with respect to the grasping members in the other of the two linear rows;

whereby a toothbrush inserted laterally into the recess is grasped and held between the first and second sets of plural resilient grasping members acting in cooperation with one another such that the toothbrush is engaged by at least two of the grasping members that are staggered with respect to one another.

3. A toothbrush holder comprising;

a body;

support structure connected to the body for supporting the body on a support surface; and one or more toothbrush graspers disposed in the body, each of the one or more graspers being accessible via a recess in the side of the body, and each of the one or more graspers comprising:

a first set of plural resilient grasping members, each of the grasping members in the first set being substantially elongated along a respective longitudinal axis, their respective longitudinal axes being substantially parallel to one another, wherein the grasping members in the first set are arranged in two linear rows that are arranged adjacent to one another; and a second set of plural resilient grasping members, each of the grasping members in the second set being substantially elongated along a respective longitudinal axis, their respective longitudinal axes being substantially parallel to one another, wherein the grasping members in the second set are arranged in two linear rows that are arranged adjacent to one another;

wherein the first set and the second set are arranged in proximate opposition to one another;

wherein the first set and the second set are both formed of resilient polymer resin; and wherein, in each of the first set and the second set, the grasping members in one of the two linear rows are arranged so as to be staggered with respect to the grasping members in the other of the two linear rows;

whereby a toothbrush inserted laterally into the recess is grasped and held between the first and second sets of plural resilient grasping members acting in cooperation with one another such that the toothbrush is engaged by at least two of the grasping members that are staggered with respect to one another.

4. A toothbrush holder comprising:

a body;

support structure connected to the body for supporting the body on a support surface; and one or more toothbrush graspers disposed in the body, each of the one or more graspers being accessible via a recess in the side of the body, and each of the one or more graspers comprising:

a first set of plural resilient grasping members, each of the grasping members in the first set being substantially elongated along a respective longitudinal axis, their respective longitudinal axes being substantially parallel to one another, wherein the grasping members in the first set are arranged in two linear rows that are arranged adjacent to one another; and a second set of plural resilient grasping members, each of the grasping members in the second set being substantially elongated along a respective longitudinal axis, their respective longitudinal axes being substantially parallel to one another, wherein the grasping members in the second set are arranged in two linear rows that are arranged adjacent to one another;

wherein the first set and the second set are arranged in proximate opposition to one another;

wherein the first set and the second set are both formed of metal; and wherein, in each of the first set and the second set, the grasping members in one of the two linear rows are arranged so as to be staggered with respect to the grasping members in the other of the two linear rows;

whereby a toothbrush inserted laterally into the recess is grasped and held between the first and second sets of plural resilient grasping members acting in cooperation with one another such that the toothbrush is engaged by at least two of the grasping members that are staggered with respect to one another.

5. A toothbrush holder comprising:

a body;

support structure connected to the body for supporting the body on a support surface; and one or more toothbrush graspers disposed in the body, each of the one or more graspers being accessible via a recess in the side of the body, and each of the one or more graspers comprising:

a first set of plural resilient grasping members, each of the grasping members in the first set being substantially elongated along a respective longitudinal axis, their respective longitudinal axes being substantially parallel to one another, wherein the grasping members in the first set are arranged in two linear rows that are arranged adjacent to one another; and a second set of plural resilient grasping members, each of the grasping members in the second set being substantially elongated along a respective longitudinal axis, their respective longitudinal axes being substantially parallel to one another, wherein the grasping members in the second set are arranged in two linear rows that are arranged adjacent to one another;

wherein the first set and the second set are arranged in proximate opposition to one another;

wherein the first set and the second set are both formed of carbon fiber; and wherein, in each of the first set and the second set, the grasping members in one of the two linear rows are arranged so as to be staggered with respect to the grasping members in the other of the two linear rows;

whereby a toothbrush inserted laterally into the recess is grasped and held between the first and second sets of plural resilient grasping members acting in cooperation with one another such that the toothbrush is engaged by at least two of the grasping members that are staggered with respect to one another.

* * * * *